US011096420B2

(12) United States Patent
Rado

(10) Patent No.: US 11,096,420 B2
(45) Date of Patent: Aug. 24, 2021

(54) PERSONAL VAPORIZER WITH MEDIUM AND CHAMBER CONTROL

(71) Applicant: Lubby Holdings, LLC, Torrance, CA (US)

(72) Inventor: J. Christian Rado, Torrance, CA (US)

(73) Assignee: Lubby Holdings, LLC, Torrance, CA (US)

( * ) Notice: Subject to any disclaimer, the term of this patent is extended or adjusted under 35 U.S.C. 154(b) by 18 days.

(21) Appl. No.: 15/016,207

(22) Filed: Feb. 4, 2016

(65) Prior Publication Data

US 2016/0219937 A1 Aug. 4, 2016

Related U.S. Application Data

(60) Provisional application No. 62/111,914, filed on Feb. 4, 2015.

(51) Int. Cl.
*A24F 40/40* (2020.01)
*A24F 40/20* (2020.01)

(52) U.S. Cl.
CPC ..... *A24F 40/40* (2020.01); *A24F 40/20* (2020.01)

(58) Field of Classification Search
CPC ..... A24F 47/00; A24F 47/008
USPC ..... 131/328
See application file for complete search history.

(56) References Cited

U.S. PATENT DOCUMENTS 2,104,266 A 1/1938 McCormick
3,200,819 A 8/1965 Gilbert
3,788,330 A * 1/1974 Griffith ..... A24D 3/045 131/201
4,036,240 A 7/1977 Murray
4,049,005 A 9/1977 Hernandez
4,292,983 A * 10/1981 Mensik ..... A24D 3/045 131/187
4,947,874 A 8/1990 Brooks et al.
6,543,448 B1 4/2003 Smith
7,832,410 B2 11/2010 Hon
7,997,280 B2 8/2011 Rosenthal
8,156,944 B2 4/2012 Han
(Continued)

FOREIGN PATENT DOCUMENTS

WO WO-2014102095 A2 * 7/2014 ..... A24D 3/045

OTHER PUBLICATIONS

Merriam-Webster Dictionary, Definition of Smoke, https://www.merriam-webster.com/dictionary/smoke (Year: 2019).*
(Continued)

*Primary Examiner* — Eric Yaary
*Assistant Examiner* — Russell E Sparks
(74) *Attorney, Agent, or Firm* — Klein, O'Neill & Singh, LLP

(57) ABSTRACT

A personal vaporizer comprises structure enabling a user to control the configuration of the vaporization chamber in which vaporizing media is atomized. In some embodiments, a personal vaporizer has an atomizer module having a heating element and a bowl for receiving vaporizing media. An adapter module is releasably attached to the atomizer module so as to be adjacent the bowl. The adapter module receives and holds a plug that can be advanced toward and away from the heating element so as to selectively change the configuration of the vaporization chamber, which is defined between the heating element and a distal end of the adapter plug.

20 Claims, 9 Drawing Sheets

(56) References Cited

U.S. PATENT DOCUMENTS

| | | | | |
|---|---|---|---|---|
| 8,365,742 | B2 | 2/2013 | Hon | |
| 8,375,957 | B2 | 2/2013 | Hon | |
| 8,393,331 | B2 | 3/2013 | Hon | |
| 8,528,569 | B1 | 9/2013 | Newton | |
| 8,794,231 | B2 | 8/2014 | Thorens et al. | |
| 8,915,254 | B2 | 12/2014 | Monsees et al. | |
| 8,925,555 | B2 | 1/2015 | Monsees | |
| 9,078,474 | B2 | 7/2015 | Thompson | |
| 9,220,303 | B2 | 12/2015 | Li et al. | |
| 9,254,007 | B2 | 2/2016 | Liu | |
| 9,380,811 | B2 | 7/2016 | Chung | |
| 9,532,599 | B2 | 1/2017 | Liu | |
| 9,750,284 | B2 | 9/2017 | Rado | |
| 1,000,426 | A1 | 6/2018 | Rado | |
| 1,002,190 | A1 | 7/2018 | Rado | |
| 1,008,548 | A1 | 10/2018 | Verleur | |
| 1,018,814 | A1 | 1/2019 | Rado | |
| 1,021,954 | A1 | 3/2019 | Rado | |
| 1,024,479 | A1 | 4/2019 | Rado | |
| 1,032,747 | A1 | 6/2019 | Rado | |
| 2005/0051182 | A1* | 3/2005 | Hcu | A24F 13/06 131/175 |
| 2009/0095287 | A1* | 4/2009 | Emarlou | A61M 11/041 128/200.14 |
| 2009/0293888 | A1 | 12/2009 | Williams | |
| 2010/0147292 | A1 | 6/2010 | Hamaguchi | |
| 2011/0061649 | A1 | 3/2011 | Hirshberg | |
| 2011/0094523 | A1* | 4/2011 | Thorens | A24F 47/008 131/194 |
| 2013/0140197 | A1* | 6/2013 | Fiebelkorn | A24D 1/042 206/205 |
| 2013/0152922 | A1 | 6/2013 | Benassayag | |
| 2013/0247910 | A1 | 9/2013 | Postma | |
| 2013/0298905 | A1 | 11/2013 | Levin et al. | |
| 2013/0306065 | A1* | 11/2013 | Thorens | A24F 47/008 128/202.21 |
| 2014/0000638 | A1 | 1/2014 | Sebastian | |
| 2014/0041655 | A1* | 2/2014 | Barron | A61M 11/042 128/202.21 |
| 2014/0069444 | A1* | 3/2014 | Cyphert | A24F 47/008 131/194 |
| 2015/0117842 | A1* | 4/2015 | Brammer | H05B 3/02 392/387 |
| 2015/0144148 | A1 | 5/2015 | Chen | |
| 2015/0208729 | A1 | 7/2015 | Monsees | |
| 2015/0208730 | A1 | 7/2015 | Li | |
| 2015/0258288 | A1 | 9/2015 | Sullivan | |
| 2016/0095357 | A1 | 4/2016 | Burton | |
| 2016/0295919 | A1* | 10/2016 | Thomas, Jr. | A61M 11/042 |
| 2017/0027223 | A1 | 2/2017 | Eksouzian | |
| 2017/0027232 | A1 | 2/2017 | Scheck | |
| 2017/0135404 | A1 | 5/2017 | Reevell | |
| 2018/0043115 | A1 | 2/2018 | Gould | |
| 2018/0177240 | A1 | 6/2018 | Duque | |

OTHER PUBLICATIONS

International Search Report from USPTO dated Apr. 14, 2016 for related International Application No. PCT/US2016/016659.

Written Opinion from USPTO dated Apr. 14, 2016 for related International Application No. PCT/US2016/016659.

* cited by examiner

PERSONAL VAPORIZER WITH MEDIUM AND CHAMBER CONTROL

CROSS-REFERENCE TO RELATED APPLICATION

This application claims priority to U.S. Provisional Application No. 62/111,914, filed Feb. 4, 2015, the entirety of which is hereby incorporated by reference.

BACKGROUND

The present disclosure relates to the field of personal vaporizers

Personal vaporizers are handheld devices that vaporize a vaporizing medium such as a liquid solution or a wax. The vapor is then inhaled by its user. A typical personal vaporizer has an atomizer with a heating element that selectively heats the medium in order to produce the vapor. A rechargeable battery is also typically employed for powering the atomizer.

Vaporizing media typically includes one or more of various essential oils, such as *cannabis* oil. Extracted flavorings can also be included.

Personal vaporizers for vaporizing wax media typically include a bowl- or cup-shaped structure at the atomizer into which wax media can be placed. Such personal vaporizers typically include a detachable mouthpiece that can be removed to provide access to the atomizer cup so that a user can place wax in the cup.

In use, the heating element of the atomizer is actuated to heat a portion of the wax sufficiently so that the wax is atomized. A user typically simultaneously draws a breath through the mouthpiece, pulling air into a vaporizing chamber defined between the bowl and mouthpiece. The air and atomized wax form a vapor that is drawn through the mouthpiece and into the user's lungs.

The effectiveness of medium vaporization diminishes as the temperature within a vaporization chamber drops, and the configuration of such a vaporization chamber may affect the quality of medium vaporization. Also, it can be desired to achieve complete or near-complete vaporization of media, thus minimizing unvaporized media, as well as to preventing or impeding unvaporized media from flowing or leaking out of the device.

SUMMARY

There is a need in the art for a personal vaporizer in which a user can control a size, shape, and/or configuration of a vaporization chamber. There is a further need in the art for a personal vaporizer having structure that minimizes the amount of media that is not vaporized during use, and a still further need in the art for a personal vaporizer that resists leaking of unvaporized media.

In accordance with one embodiment, the present specification provides a personal vaporizer, comprising an atomizer module comprising a bowl having a sidewall and a proximal edge, a heating element being arranged in or adjacent the bowl, the bowl being configured to accept a wax having an essential oil. The atomizer module is connectable to a battery assembly so that actuation of the battery delivers electrical energy to the heating element, causing the heating element to heat and vaporize a wax that may be in the bowl. An adapter module is detachably connected to the atomizer module, the adapter module having an elongated hollow body and an adapter plug. The adapter plug has a distal end, and the adapter plug is arranged within the adapter module elongated hollow body so that the distal end is disposed at or adjacent the heating element so that a vaporizing chamber is defined between the heating element and the distal end of the adapter plug.

In some such embodiments a portion of the distal end of the adapter plug engages the proximal edge of the bowl. Some such embodiments additionally comprise one or more slots formed through a side wall of the bowl.

In further embodiments, the plug is selectively movable longitudinally relative to the adapter module from a first longitudinal position to a second longitudinal position.

In still further embodiments a vapor space is disposed between the adapter plug and an inner surface of the adapter module elongated hollow body.

In yet additional embodiments a distal surface of the plug defines a distal cavity.

In yet further embodiments the distal end of the adapter plug is arranged distal of the proximal edge of the bowl. In some such embodiments a diameter of the distal end of the adapter plug is less than the diameter of the side wall of the bowl.

In accordance with another embodiment the present specification provides a method of using a personal vaporizer. The method includes detaching an adapter module from an atomizer module so as to gain access to a bowl of the atomizer module, the bowl having a sidewall and a proximal edge, a heating element being arranged in the bowl, and depositing a wax having an essential oil into the bowl. The adapter module is reattached to the atomizer module so that an adapter plug of the atomizer module is positioned at or adjacent the heating element. The method additionally comprises actuating the heating element so that the heating element vaporizes at least a portion of the wax, and drawing a breath through a mouthpiece so that ambient air is mixed with vaporized wax and drawn through and out of the mouthpiece.

Some such embodiments additionally comprise adjusting a longitudinal position of the adapter plug relative to an adapter body of the adapter module. In further embodiments, when the adapter module is reattached to the atomizer module a distal end of the adapter plug is positioned longitudinally distal of a proximal end of the bowl. In other embodiments, when the adapter module is reattached to the atomizer module a distal end of the adapter plug engages a proximal end of the bowl.

DESCRIPTION

Figure 2:
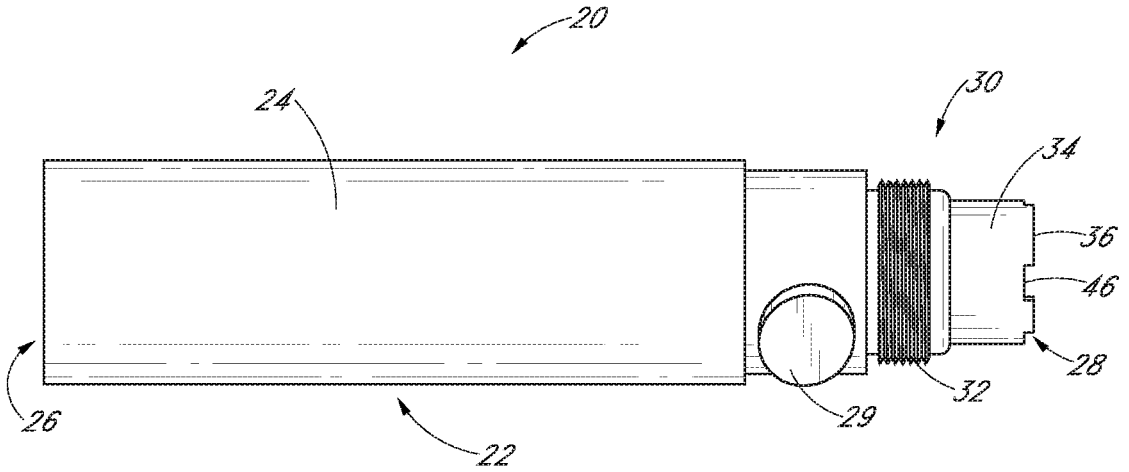
FIG. 2 is a side view of the battery assembly of FIG. 1.
Figure 1:
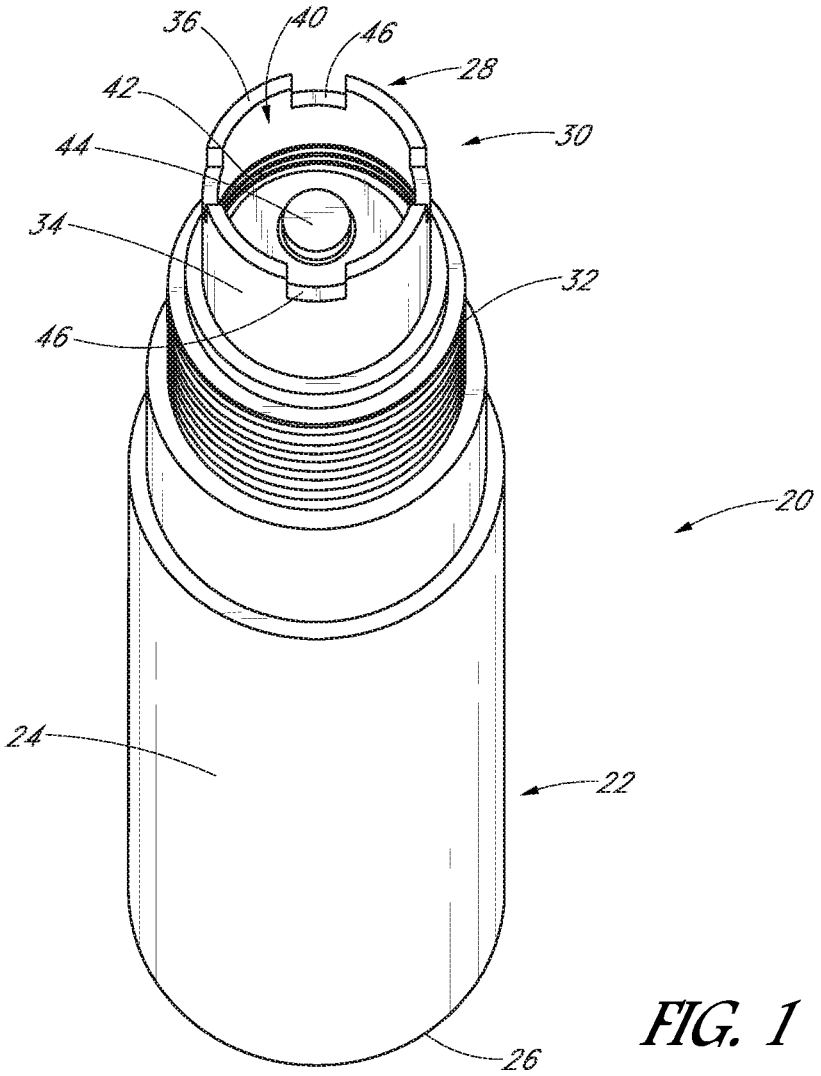
FIG. 1 is a perspective view of a battery assembly for use in some embodiments.

With initial reference to FIGS. 1 and 2, an embodiment of a battery assembly 20, or battery pack, for a personal vaporizer is illustrated. Certain features of the illustrated battery assembly 20 are typical of battery assemblies currently available on the market. For example, the battery assembly 20 may include a rechargeable battery, such as a lithium-ion battery, enclosed within a battery casing 22. The battery casing 22 may include an elongated body 24 that extends from a base or distal end 26 to a top or proximal end 28. An electronic controller may also be included within the casing 22 to control voltage, current, timing and the like. A button 29 may be provided for selectively actuating electricity delivery from the battery 20 to the atomizer. In some embodiments, the button 29 can include a light that indicates when power is being delivered.

With continued reference to FIGS. 1 and 2, at and adjacent the proximal end 28 of the battery assembly 20, the battery casing 22 defines a mount boss 30. The mount boss 30 includes connecting structures for connecting vaporizing structures, such as atomizers and fluid chambers, to the battery. The elongated body 24 is disposed distally of the mount boss 30. In some embodiments, the body 24 may include a decorative coating or sleeve that is configured to enhance the look of the vaporizer. For example, the body 24 may come in many different colors and/or have one or more unique and aesthetically pleasing surface treatments. Some embodiments may include a decorative sleeve that is selectively removable.

In the illustrated embodiment, the battery assembly mount boss 30 comprises an externally threaded portion 32 adjacent the decorative body 24. Preferably, the externally threaded portion 32 has a diameter somewhat smaller than a diameter of the decorative body 24. An extension 34 extends in a proximal direction from the externally threaded portion 32, preferably terminating in a top or proximal surface 36. As best shown in FIG. 2, the extension 34 preferably is tubular, defining a mount cavity 40 therewithin and having internal threads 42. Preferably, a diameter of the tubular extension 34 is less than the diameter of the externally threaded portion 32. A battery contact 44 is disposed within the tubular extension 34 at the base of the mount cavity 40. As shown, preferably a plurality of air intake slots 46 are formed in the extension at and adjacent the top surface.

As noted above, one or more vaporizing structures are attachable to the battery mount boss 30. Such vaporizing structures typically include an atomizer, mouthpiece and, in some embodiments, a fluid chamber or one or more other vaporizer structures, which can be provided as separate pieces or combined as a single structure. The vaporizing structures can be of various styles, sizes, and configurations.

Vaporizing structures can also be attached to the battery assembly 20 in various ways. In some embodiments, an atomizer can threadingly engage the external threads 32 of the battery mount boss 30. In other embodiments, an atomizer may threadingly engage the internal threads 42 of the mount cavity extension 40. Preferably, a pin or other elongated contact extends into the mount cavity 40 to engage the battery contact 44 so as to communicate power from the battery 20 to the atomizer. Additional embodiments can employ non-threaded connection structures such as detents, friction fits, J-locks, and the like.

Figure 3:
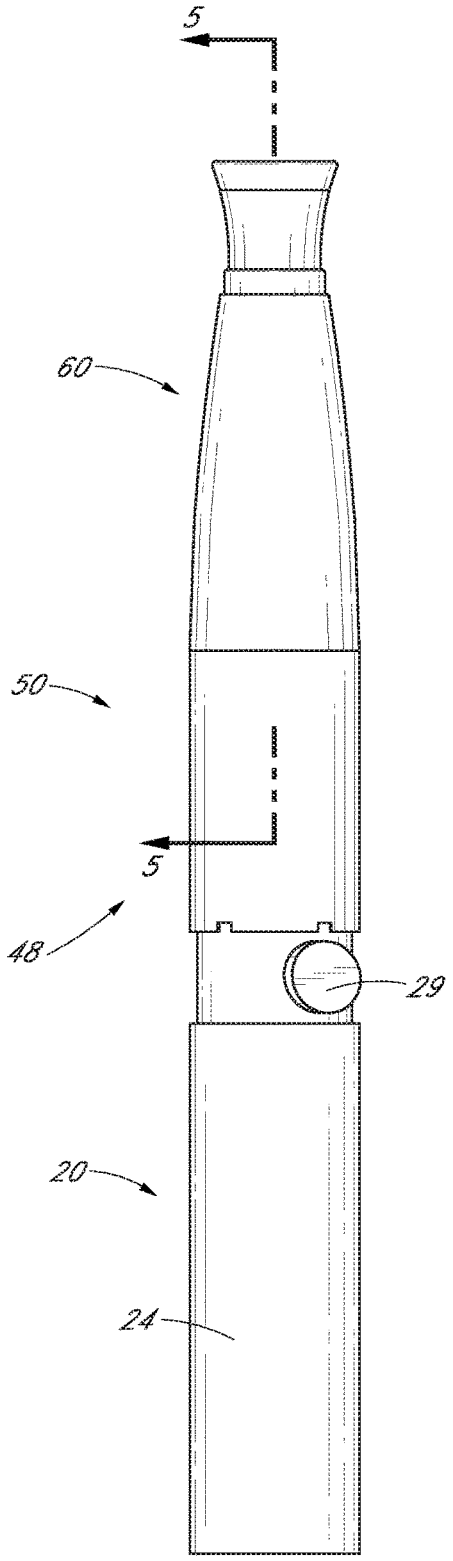
FIG. 3 is a side view of an embodiment of a personal vaporizer having a modular construction.
Figure 4:
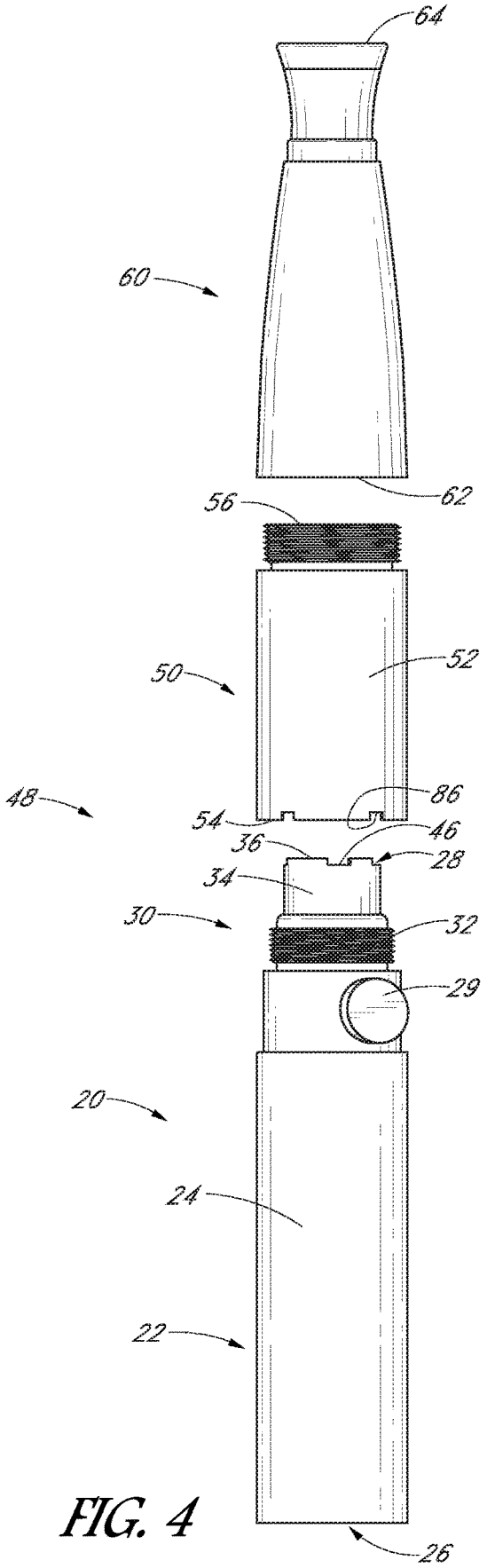
FIG. 4 is an exploded view of the personal vaporizer of FIG. 3.
Figure 6:
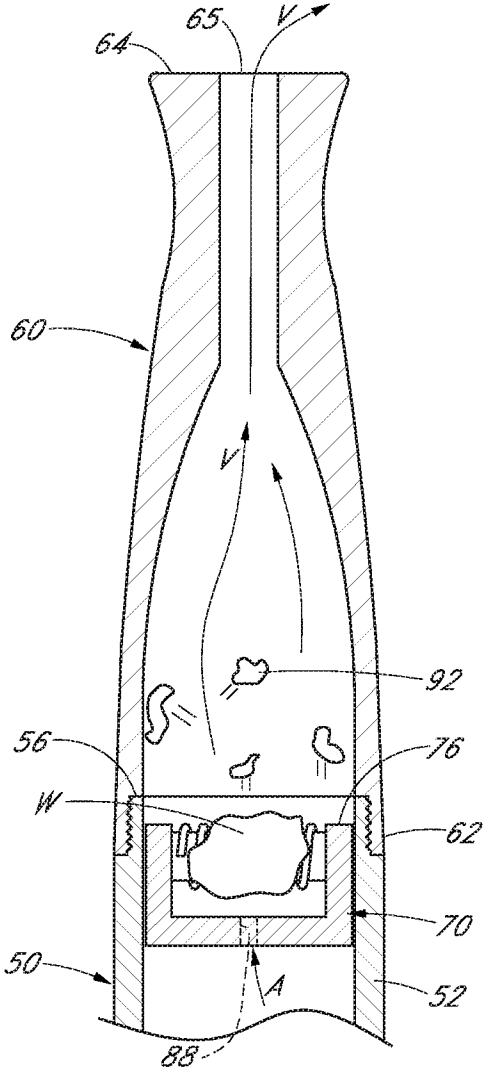
FIG. 6 shows the structure of FIG. 5 in use vaporizing a medium.
Figure 5:
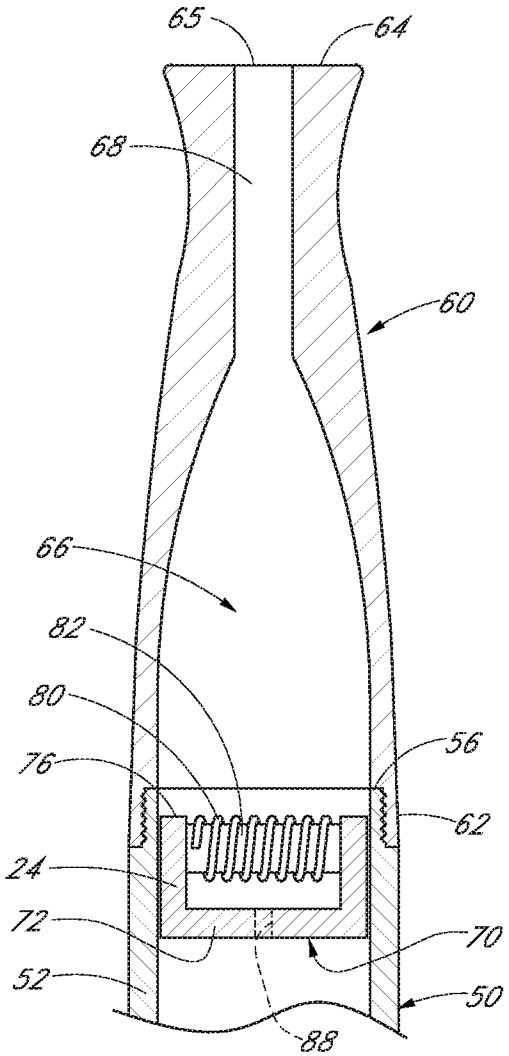
FIG. 5 is a cross sectional view taken along lines 5-5 of FIG. 4.

With reference next to FIGS. 3-5, one embodiment of a personal vaporizer 48 comprises an atomizer module 50 and a mouthpiece module 60 that are threadingly attachable to one another and to a battery 20. The illustrated atomizer module 50 has an elongated body 52 having a distal end 56 and a proximal end 58. The distal end 56 is threadingly attachable to the mount boss 30 of the battery 20 so that electric power can be provided to a heating element in the atomizer. The mouthpiece module 60 also comprises a distal end 62 and a proximal end 64. The distal end 62 of the mouthpiece module 60 is threadingly attachable to and detachable from the proximal end 54 of the atomizer module 50. The mouthpiece module 60 preferably is tubular, delivering vapor V generated in the atomizer module 50 to and through an outlet 65 at its proximal end 64 for delivery to the user. As best shown in FIGS. 5 and 6, the mouthpiece preferably is tubular, defining a mouthpiece chamber 66 and a mouthpiece vapor passage 68 therewithin.

As best shown in FIG. 5, the atomizer module 50 comprises a container or bowl 70 at or adjacent the proximal end 54 of the atomizer module 50. The atomizer bowl 70 preferably defines bottom 72 and side walls 74 and is open at the top, or proximal, end 76. Preferably, the bowl 70 is an insulator, and can be made of an insulator material such as a ceramic. The heating element is disposed within the bowl 70 and, in the illustrated embodiment, comprises a coil 80 supported upon a transverse bar or wick 82 (coil support). The wire coil 80 can be constructed of a durable, electrically-conductive material such as a metal (such as titanium, Kanthal® alloy, or nichrome) that provides durability and electrical conduction to selectively power the atomizer. With additional reference to FIG. 6, a vaporizing medium such as a wax W can be placed into the bowl 70 on or around the coil 80. This style of atomizer module can be referred to as a skillet-style atomizer module due to its bowl structure, which accommodates the wax and/or other atomizable media.

In the illustrated embodiment, a user gains access to the atomizer bowl 70 by detaching the mouthpiece module 60. The user may then deliver vaporizing media, such as the wax W, through the open proximal end of the atomizer module 50 and into the bowl 70. The user preferably replaces the mouthpiece module 60 in order to use the personal vaporizer 48.

The distal end 52 of the atomizer body has a plurality of slots 86 formed therein. A distal atomizer connector pin (not shown) preferably is externally threaded so as to threadingly engage the internal extension threads 42 of the battery assembly. The pin extends into the mount cavity to engage the battery contact 44 so as to communicate electrical power from the battery to the coil when the button 29 is depressed. Also, the atomizer slots 86 and battery boss slots 46 cooperate to enable ambient air A to be drawn through the distal end 52 of the atomizer module 50. Preferably, an air aperture 88 is formed through the bowl 70 so that the air A can flow through the bowl 70 and past the coil 80.

In practice, and with particular reference to FIGS. 5 and 6, when the user presses the button 29 to actuate the battery 20, the coil eight is quickly heated, causing a portion of the wax W to be atomized. The user typically simultaneously draws a breath through the mouthpiece 60, pulling air A into a vaporizing chamber 90 defined between the bowl 70 and the surface of the mouthpiece chamber 66, where it mixes with the atomized wax to form a vapor V. The vapor V is then pulled through the mouthpiece vapor passage 68 and into the user's lungs.

Continuing with reference to FIGS. 5 and 6, the chamber 66 defined in the mouthpiece and above the bowl 70 is relatively large. Thus, a relatively large vaporizing chamber 90 is defined between the mouthpiece chamber surface and the coil. Fast heat dissipation is especially prominent in vaporizer designs having large vaporizing chambers such as that shown in FIGS. 3-6. The effectiveness of medium vaporization diminishes as the temperature drops within the vapor chamber. As such, less usable vapor can be expected to be generated from wax medium vaporized in a large vaporizing chamber than from wax medium vaporized in a small vaporizing chamber. Also, in personal vaporizers, heat can dissipate relatively quickly once the battery stops energizing the coil. Although vapor is still generated after the coil is no longer actuated, such vapor generation will decrease quicker in a large vaporizing chamber than in a small vaporizing chamber.

Also, when the coil 80 is energized, and when the user draws vapor through the mouthpiece, the wax medium W can be expected to boil, resulting in splattering, in which unvaporized portions 92 of the medium splatter upon non-heated surfaces, such as the surface of the mouthpiece chamber 66. Further, when warmed but not vaporized, the viscosity of the wax medium can be lowered substantially, possibly causing it to be readily flowable. In such a condition, if the user tilts the vaporizer 48 on its side, or upside down, the wax medium is susceptible to flowing and may flow out of the bowl onto surfaces of the mouthpiece chamber, or even out of the mouthpiece outlet and/or through the bowl air aperture. During such events, when atomizable medium exits the bowl, the medium may be wasted by leaking or by becoming adhered to surfaces (such as portions of the mouthpiece chamber surface) where it will not be heated sufficiently to be atomized.

Figures 7, 8:
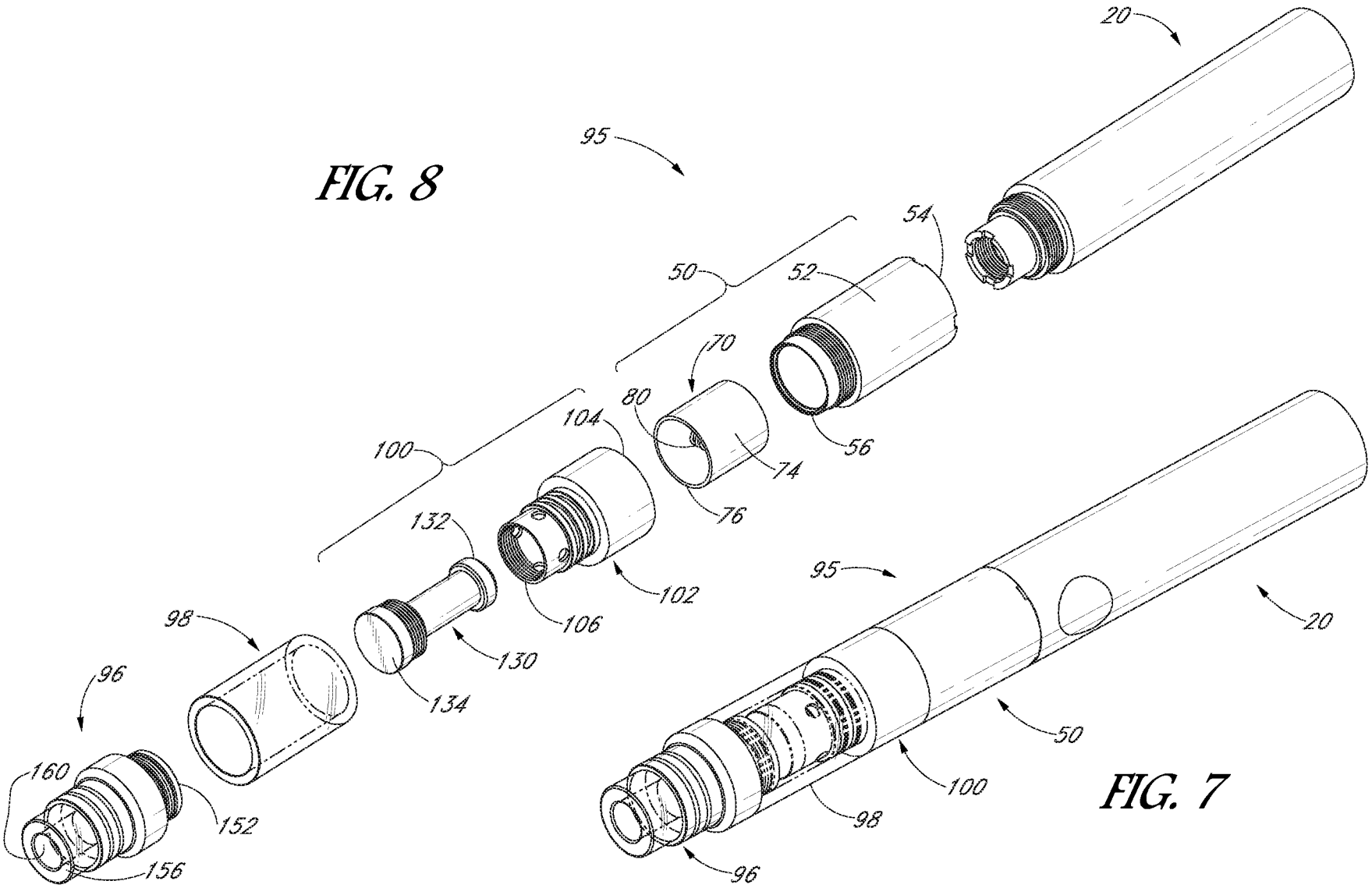
FIG. 7 is a perspective view of a personal vaporizer configured in accordance with another embodiment.
FIG. 8 is an exploded view of the personal vaporizer of FIG. 7

With reference next to FIG. 7, an embodiment of a personal vaporizer 95 comprises a battery assembly 20 upon which an atomizer module 50 is mounted. An adapter module 100 is attached to the atomizer module and attaches to a mouthpiece module 96 by way of a tubular member 98.

With additional reference to FIG. 8, the atomizer module 50 preferably comprises an elongated body 52 having a distal end 54 and a proximal end 56. A bowl 70 has a bottom 72 and side walls 74 and is open at or adjacent its top, or proximal end 76. A heating element is arranged in the bowl, and preferably comprises at least one coil 80 wrapped about a wick 82. The bowl 70 is fit into the body 52 at and adjacent the proximal end 56 of the atomizer body 52. The distal end 54 of the atomizer body 52 includes air slots 86 and is configured to attach to a mount boss 30 of the battery assembly 20 so that the battery can selectively supply electric power to the coil 80.

Figure 9C:
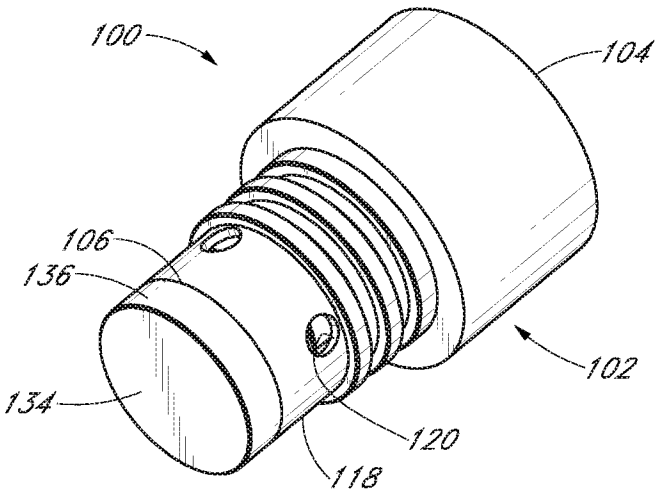
FIG. 9C shows the adapter module of FIG. 9A assembled in a second position.
Figure 9B:
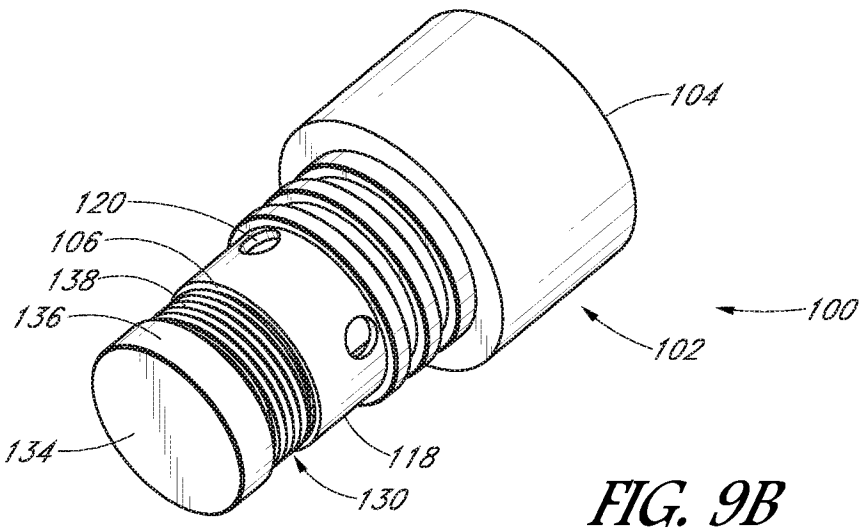
FIG. 9B shows the adapter module of FIG. 9A assembled in a first position.
Figure 9A:
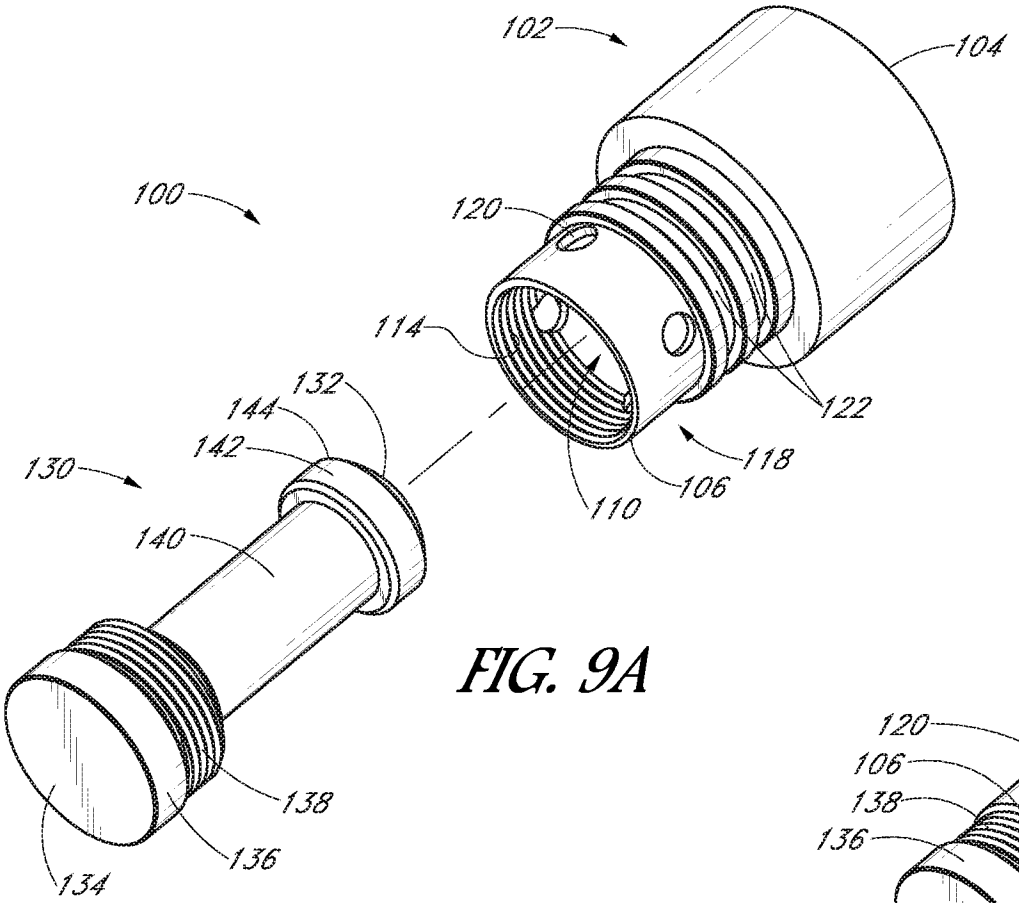
FIG. 9A is an exploded view of an adapter module in accordance with one embodiment.
Figure 10B:
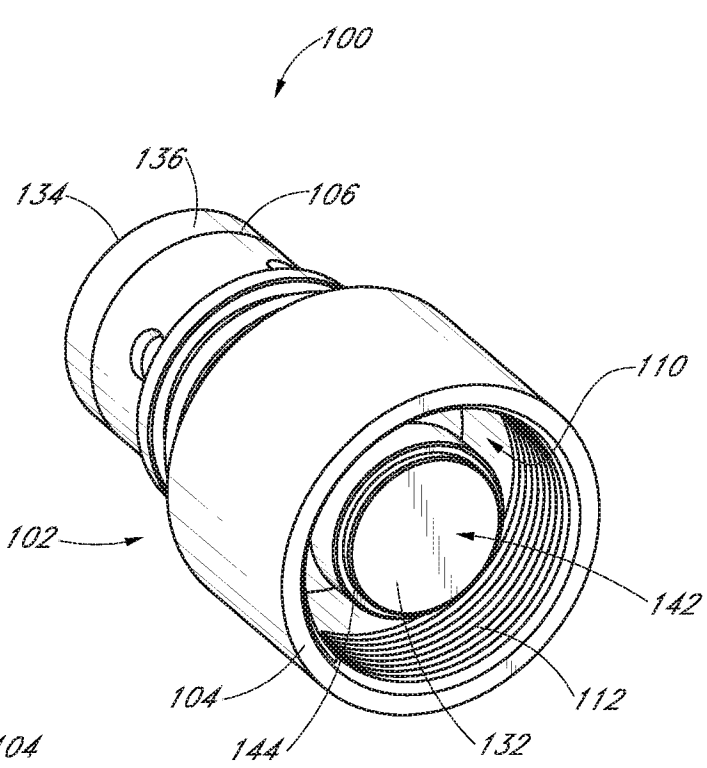
FIG. 10B shows the adapter module of FIG. 10A assembled in the second position also depicted in FIG. 9C.
Figure 10A:
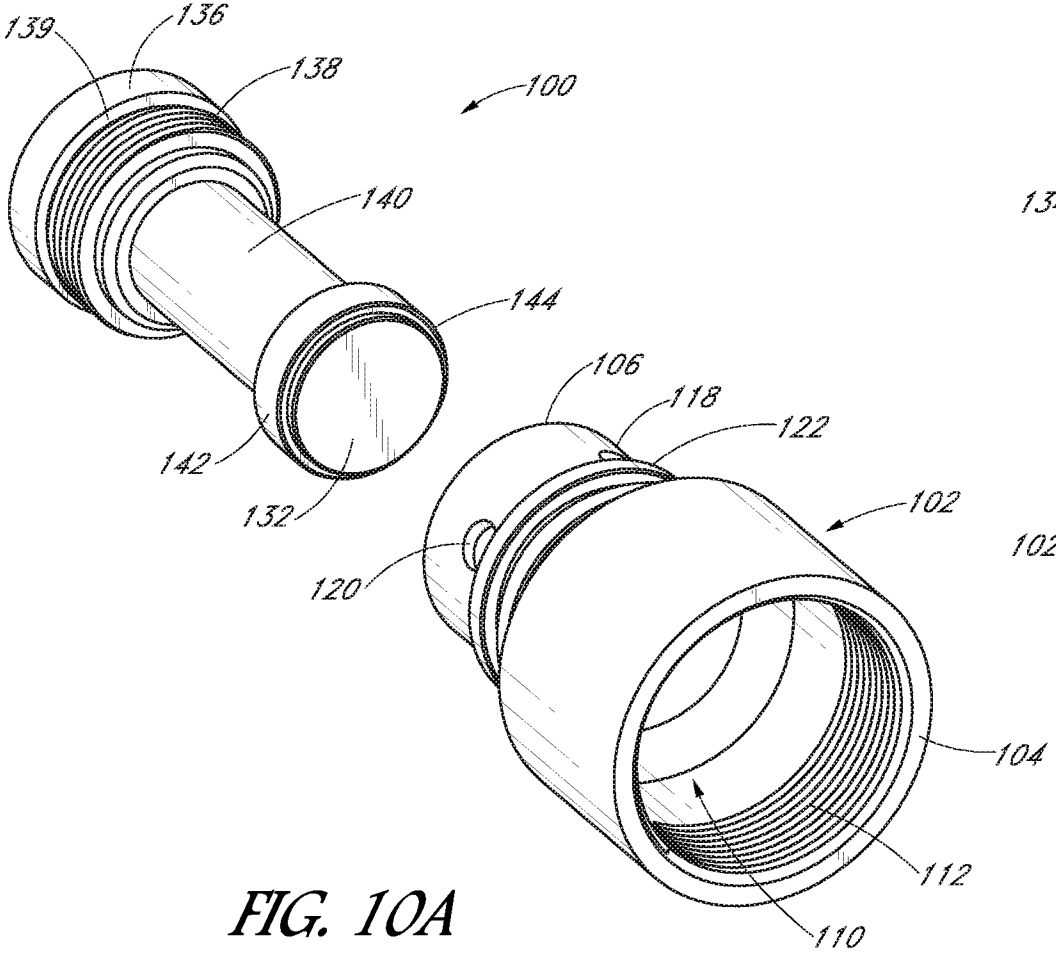
FIG. 10A is another exploded view of the adapter module of FIG. 9A.

With additional reference to FIGS. 9 and 10, the illustrated adapter module 100 comprises an elongated, tubular adapter body 102 having a distal end 104 and a proximal end 106 and defining an adapter body lumen 110 therewithin. The illustrated adapter body 102 has internal threads 112 adjacent its distal end 104 so as to be releasably attachable to the threaded proximal end 56 of the atomizer body 52. The proximal end 106 of the adapter body 102 also has internal threads 114. A reduced-diameter portion 118 of the adapter body is defined at and adjacent the proximal end 106. Flow holes 120 are formed through a side wall of the adapter body 102 in the reduced diameter portion 118. In the illustrated embodiment, a pair of O-ring seats 122 are formed distal of the flow holes 120. O-rings 124 can be fit into and supported by the O-ring seats 12.

With continued reference to FIGS. 7-10, the adapter module 100 also includes an adapter plug 130 having a distal end 132 and a proximal end 134. A head 136 is defined at and adjacent the proximal end 134, and the plug 130 has external threads 138 distal of the head 136. A stop surface 139 is defined between the head 136 and the external threads 138, which have a diameter less than that of the head end 136. Preferably, the external threads 138 are sized and adapted to engage with the internal threads 114 adjacent the proximal end 106 of the adapter body 102. An elongated shaft 140 extends between the head 136 and a distal base portion 142 at and adjacent the distal end 132. The distal base portion 142 has a distal outer edge 144 at the distal end 132 which, in the illustrated embodiment, has a greater diameter than does the shaft 140.

With specific reference to FIGS. 9B, 9C and 10B, the adapter plug 130 is configured to be advanced into the adapter body lumen 110 so that the plug threads 138 engage the proximal threads 114 of the body 102. As such, the adapter plug 130 can be held within the adapter body 102 over a range of positions. For example, FIG. 9B shows the plug 130 in a first position relative to the body 102 and FIGS. 9C and 10B show the plug 130 advanced distally relative to the body 102 to a second position. In the second position, the stop surface 139 of the head and 36 is engaged with the proximal end 106 of the adapter body 102 so as to prevent the plug 130 from extending any further distally relative to the adapter body 102.

Figure 11:
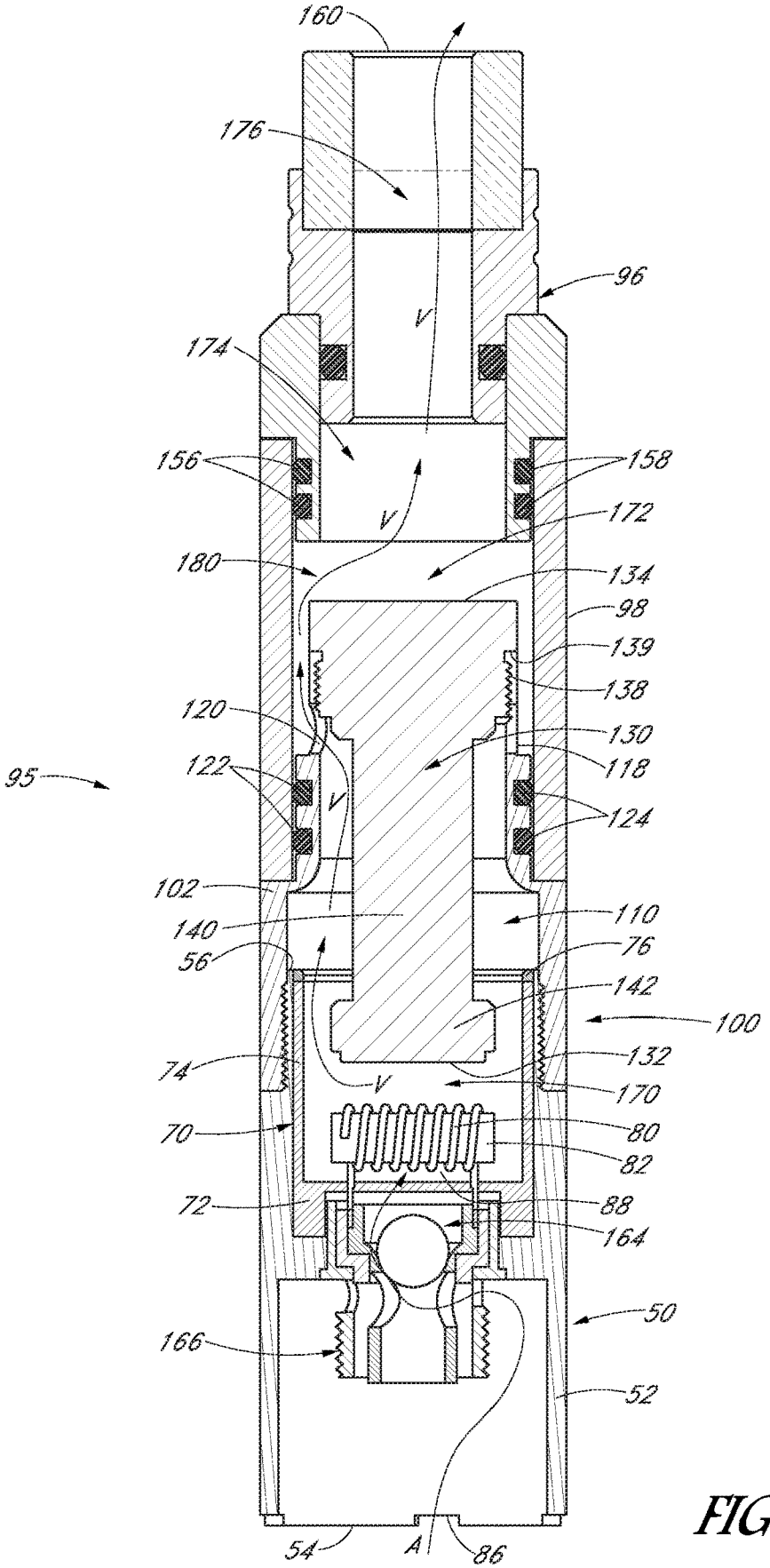
FIG. 11 is a cross-sectional view taken along lines 11-11 of FIG. 7.

With additional reference again to FIGS. 7 and 8, and also to FIG. 11, the tubular member 98 fits over the reduced-diameter portion 118 of the adapter body 102 and engages O-rings 124 disposed in the seats 122 so as to create a seal.

The mouthpiece module 96 comprises a distal end 152 and a proximal end 154. O-ring seats 156 adjacent the distal end 152 have O-rings 158 fit therewithin, and the distal end 152 fits within the tubular member 98 so that the O-rings 158 sealingly engage the inner surface of the tubular member 98. An outlet 160 is defined at the proximal end 154 of the mouthpiece module 96.

In a preferred embodiment, the tubular member 98 is made of a clear material such as glass. It is to be understood, however, that other materials, such as a metal, also can be used for the tubular member. Further, additional embodiments may use different structure to secure the tubular member between the mouthpiece module and the adapter module. For example, rather than O-rings, the tubular member can be attached to one, the other, or both the mouthpiece module and adapter module by way of threads or other attachment structure. In still further embodiments, the tubular member can be integrally incorporated as part of the mouthpiece module, but releasably attachable to the adapter module.

With continued reference to FIGS. 7-11, the illustrated atomizer module 50 preferably comprises a check valve 164 distal of the bowl 70. Preferably, a distal pin of the atomizer body 52 is configured to attach to the battery mount boss 30. Thus, when the atomizer module 50 is attached to the battery assembly 20, air can flow through the atomizer air slots 86, battery slots 46, and check valve 164 and into the atomizer module 50. Structure of the check valve and the connection of the atomizer module to the battery can vary as desired. Some embodiments may incorporate structure as discussed in Applicant's co-pending application Ser. No. 14/985,389, filed Dec. 30, 2015, the entirety of which is hereby incorporated by reference. Further embodiments may or may not include a check valve.

A vaporizing chamber 170 is defined between the distal end 132 of the plug 130 and the coil 80. In the illustrated embodiment, when the adapter plug 130 is fully advanced to the second position as shown in FIGS. 9C, 9B and 11, the distal end 132 of the plug 130 is disposed within the bowl 70 and adjacent the coils 80.

Continuing with reference to FIG. 11, a user may load the vaporizer 95 by removing the adapter module 100 from the atomizer body 52 and placing a wax W within the bowl 70, preferably atop the coil 80. The adapter body 102 is then replaced onto the atomizer body 52. When the user draws a breath through the mouthpiece 96 and presses the button 29 to energize the coils. Ambient air A is drawn past the coil 80 and wax W is atomized and mixed with the air A in the vaporizing chamber 170 to form a vapor V. To exit the vaporizing chamber 170, the vapor V travels laterally around the distal base portion 142 of the plug 130, and then changes direction to flow generally longitudinally between the distal base portion 142 and the side wall 74 of the bowl 70. The vapor further flows through the adapter body lumen 110 between the inner surface of the adapter body 102 and the plug shaft 140, and further through the flow holes 120 and into a secondary vapor chamber 172 formed by the tubular member 98. The vapor V then flows into a mouthpiece chamber 174 formed within the mouthpiece module 96, and further through a mouthpiece vapor passage 176 and out of the outlet 160.

In the illustrated embodiment, the distal end 132 of the plug 130 is arranged very close to the coil 80. As such, for example, splatter 92 that may occur when the wax is boiled by the coil 80 is contained by the distal end 132 of the plug 130 and thus remains close to the coil 80. In the illustrated embodiment, the distal end 132 of the plug is close enough to the coil 80 so that splatter 92 on the distal end 132 will be heated sufficiently to be atomized. Further, with the distal end 132 of the plug 130 close to the coil 80, the vaporizing chamber 170 is quite small, and will thus retain heat, resulting in a more thorough vaporization of vaporizing media. In another embodiment, the distal end of the plug is sufficiently close so that splatter on the distal end is warmed sufficiently that its viscosity reduces and it flows, or drips, back to the coil, where it is then vaporized. Thus, the illustrated embodiment and related embodiments reduce or prevent losses of vaporized atomized medium through splattering and/or flowing out of the bowl.

In the illustrated embodiment, the user may adjust the size and configuration of the vaporizing chamber 170 as desired. For example, with specific reference to FIGS. 9B and 11, the user may remove the tubular member 98 so as to access the head 136 of the adapter plug 130. Rotating the adapter plug head 136 counterclockwise will move the adapter plug 130 proximally, such as toward or to the first position illustrated in FIG. 9B. In this position, the distance between the distal end 132 of the adapter plug 130 and the coil 80 is greater than it is when the plug 130 is in the second position, resulting in decreased atomization of media and faster cooling of the vaporizing chamber. For some users, and for some media, such configurations may be preferred.

With specific reference again to FIG. 11, an adjustment space 180 is disposed between the head 136 of the adapter plug 130 and the distal end 152 of the mouthpiece module 96. Preferably the space 180 is of the length sufficient to accommodate the plug head 136 over the plug's full range of longitudinal positions, such as between the first position depicted in FIG. 9B and the second position depicted in FIGS. 9C and 11.

It is to be understood that, in some embodiments, the adapter body 102 is attached to the atomizer 50 before the adapter plug 130 is inserted into the adapter body 102. In other embodiments, the adapter plug can be placed into the body before the body is attached to the atomizer module. Further, in some embodiments, in order to load the device with vaporizing media, a user may first remove the plug and then drop media such as wax through the proximal end of the adapter body and/or apply a portion of wax to the distal end of the plug base. The plug can then be advanced through the lumen of the body and into place with its distal base adjacent the coil.

It is to be understood that the inventive concepts discussed herein can be applied to a plurality of different structural embodiments. For example, with reference next to FIG. 12, a cross-section of another embodiment of an adapter plug 190 and adapter body 102 is shown. In the illustrated embodiment, the distal base 191 of the adapter plug 190 has a diameter greater than the inner diameter of the bowl 70. As such, the distal edge 192 of the adapter plug 190 engages the bowl upper edge 76. In this embodiment, preferably a plurality of slots 200 are formed in the bowl side wall 74 at and adjacent the bowl upper edge 76. Thus, vapor V can flow through the slots 200.

Due to manufacturing variances, the position of the bowl upper edge 76 relative to the proximal edge 56 of the atomizer module body 52 may vary somewhat from vaporizer to vaporizer. Since the plug 190 is threadingly advanceable within (or with) the adapter body 102, such variances can be accommodated so that the plug distal edge 192 engages the bowl upper edge 76. In the embodiments discussed above, the adapter plug is advanced relative to the adapter body. In some embodiments, the plug may be held within the body, and advancement of the distal end of the plug is determined by the extent to which the adapter body is threadingly advanced over the atomizer module.

Figure 12:
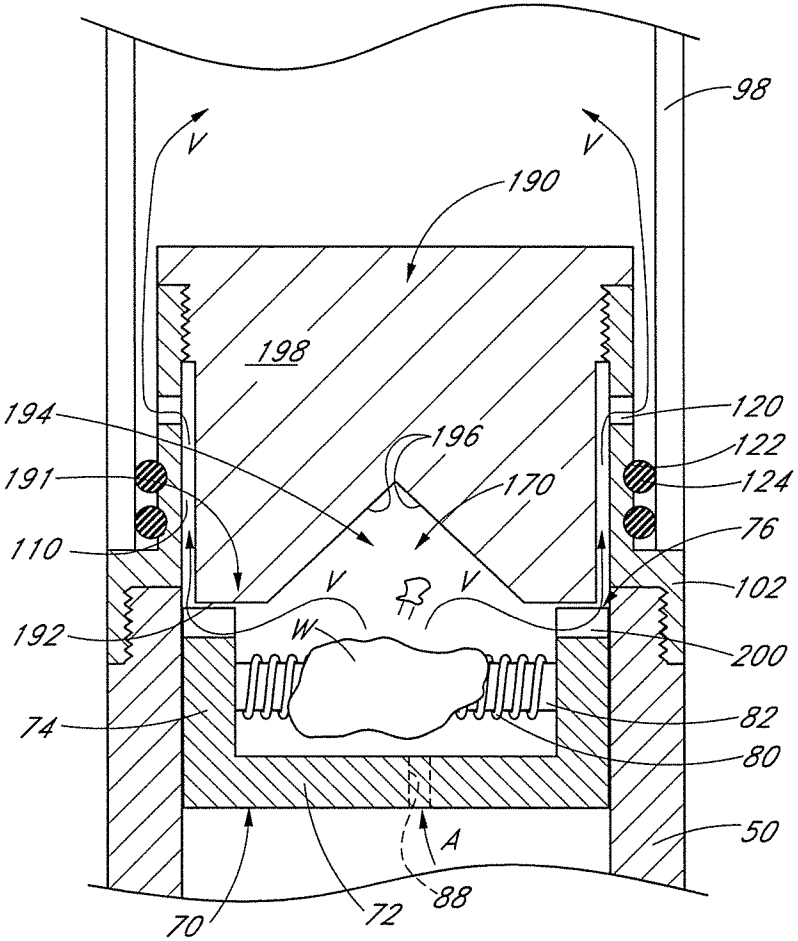
FIG. 12 is a cross-sectional view of a portion of a personal vaporizer having an adapter module configured in accordance with another embodiment.

Continuing with reference to FIG. 12, the distal base 191 of the illustrated plug 190 has a distal cavity 194 defined by sloping surfaces 196. More particularly, the sloping surfaces 196 are sloped relative to a longitudinal axis of the bowl 70. With the plug 190 appropriately in place as shown, the plug distal cavity 194 is disposed immediately above the bowl 70 and coil 80 of the atomizer module 50, and the vaporization chamber 170 is defined between the bowl 70 and plug distal cavity surfaces 196. Also, in the illustrated embodiment, the shaft 198 of the plug 190 has a diameter substantially the same as the distal edge 192 of the plug base 191. As can be appreciated, the vaporization chamber 170 is relatively small in this configuration. Thus, heated air and vapor within the vaporization chamber is more likely to retain that heat for a longer time, leading to better and more effective vaporization of the medium. Further, as discussed above, if desired, a user can adjust the size of the vaporization chamber by varying how far the plug is threaded into the adapter module.

Continuing with reference to FIG. 12, the plug distal cavity 194 constrains vapor V generated by heating the medium by the coil 80 in the bowl 70 within the vaporizing chamber 170. Also, splatter and the like, which can be expected when heating the medium, is contained within the relatively small vaporization chamber. Further, with the plug distal end 192 engaged with the bowl upper edge 76, heated medium having low viscosity will be fully or mostly retained within the vaporization chamber 170 even if the vaporizer is tilted on its side, upside down or the like. Also, in the illustrated embodiment, the distal ends of the sloped surfaces 196 of the plug distal cavity 194 overhang portions of the bowl upper edge 76 so that splatter and the like that may accumulate on a sloping surface 196 of the plug distal cavity 194, when heated to have a low viscosity, can flow downwardly and drop back into the bowl 70 for possible vaporization.

Continuing with reference to FIG. 12, when the plug distal edge 191 is engaged with the bowl upper edge 76, the only route for vapor V to escape the vaporization chamber 170 is through the slots 200 in the bowl side walls 74. As such, vapor V must flow through the slots 200 and into the lumen 110 defined between the plug shaft 198 and the adapter body inner surface. Vapor will continue to flow through the lumen 110 and out the flow holes 120 of the adapter body 102, as shown. It is to be understood that such a configuration forces the vapor flow path to make a plurality of substantial changes in flow direction, defining a tortuous vapor pathway. As such, media solids that may be entrained in the vapor are more likely to fall out of the vapor and not be carried out of the vaporization chamber with the vapor. Such entrained media solids will thus be retained within the vaporization chamber, possibly eventually being vaporized. Thus, vapor quality is improved and loss of unvaporized media is reduced. It is to be understood that other embodiments, including the embodiment discussed above in connection with FIGS. 7-11, can also employ tortuous vapor pathways.

Figure 13:
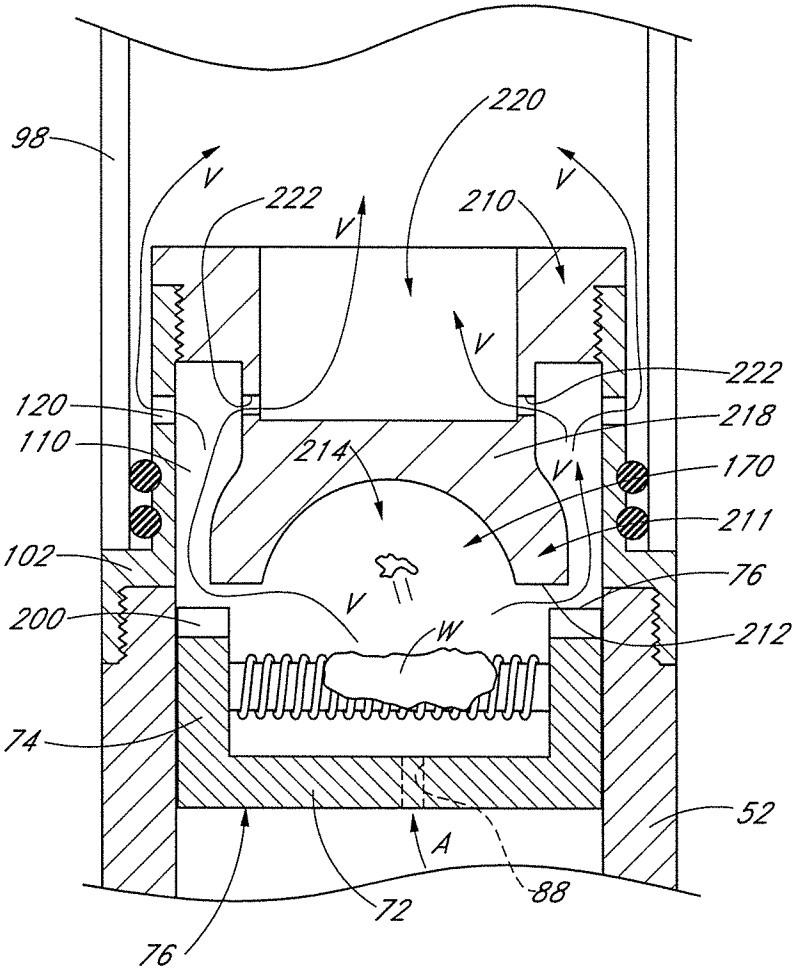
FIG. 13 is a cross-sectional view of a portion of a personal vaporizer having an adapter module configured in accordance with still another embodiment.

With reference next to FIG. 13, another embodiment of an adapter plug 210 is shown. In this embodiment, the adapter plug 210 has a larger diameter at and adjacent its distal base 211 than it has at the shaft 218 proximal of the distal base 211. As such, the lumen 110 between the plug shaft 218 and the inner surface of the adapter body 102 has a greater cross-sectional area adjacent the plug shaft 218 than it does adjacent the plug distal base 211. This configuration reduces constrictions on vapor flow. Further, in the illustrated embodiment, the plug 210 has a proximal cavity 220 and plug apertures 222 that communicate the lumen 110 with the plug proximal cavity 220 so that vapor V can flow through the lumen 110 and into the plug proximal cavity 220, in addition to vapor flowing from the lumen 110 through the flow holes 120 of the adapter body 102.

In yet additional embodiments, the adapter body may not have flow holes. Thus, vapor is constrained to flow from the lumen only into the plug proximal cavity. The illustrated adapter plug distal base also has a distal cavity 214 having a surface 216 defining a generally semicircular cross-sectional shape. As such, the shape of the vaporization chamber 170 is somewhat different than, for example, in the embodiment of FIG. 12. It is to be understood that various shapes for the plug distal cavity 214 can be employed as desired. Still further embodiments can include yet additional structural configurations. For example, rather than (or in addition to) having slots formed through the bowl side walls, slots can be formed through the distal edge of the plug base.

Figure 14:
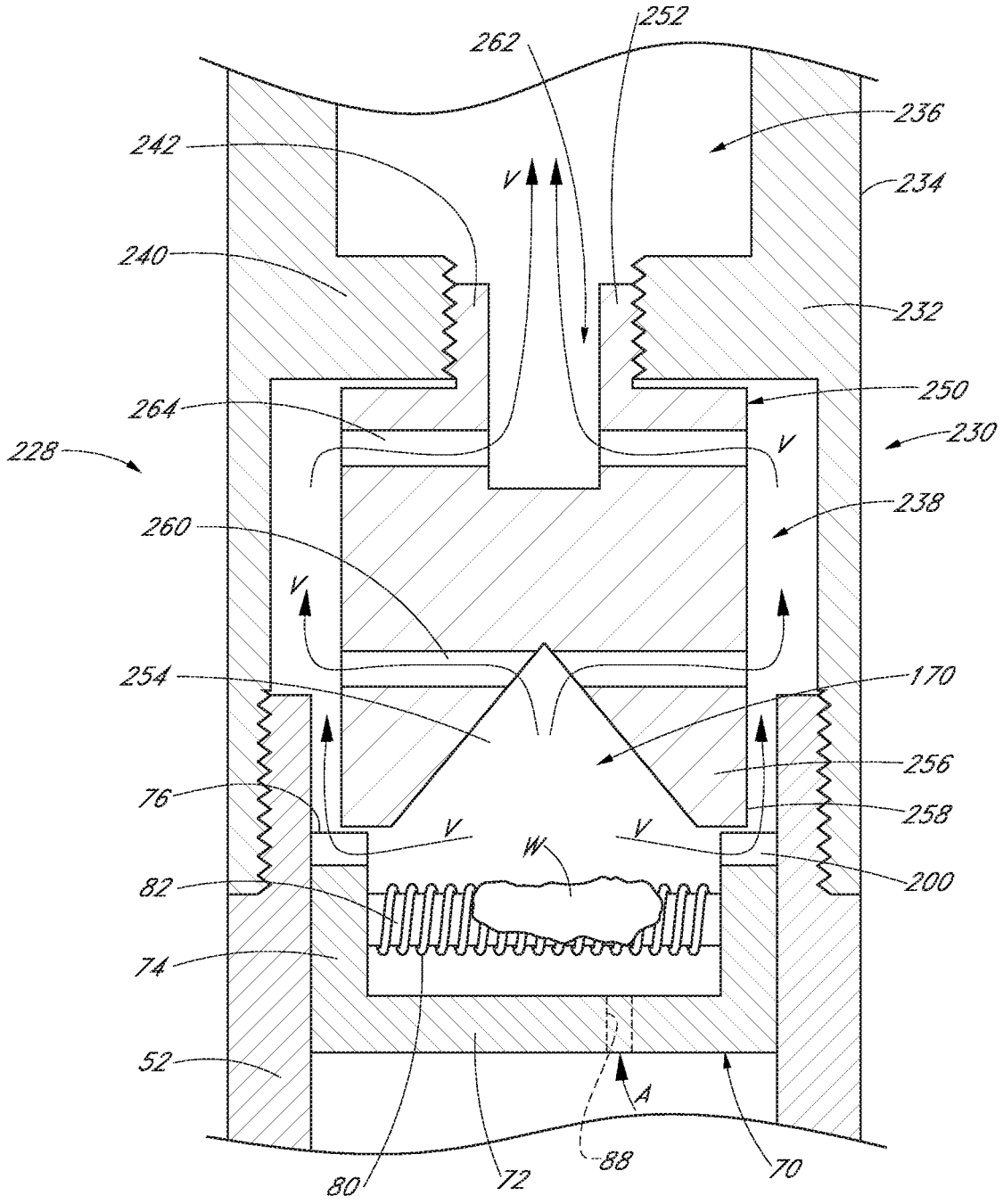
FIG. 14 is a cross-sectional view of a portion of another embodiment of a personal vaporizer having an adapter module configured in accordance with yet another embodiment.

With reference next to FIG. 14, a portion of another embodiment of a personal vaporizer 228 employing another embodiment of an adapter module 230 is shown. In the illustrated embodiment, the adapter module 230 comprises an elongated adapter body 232 having a tubular outer wall 234 that defines proximal and distal cavities 236, 238 that are separated by a septum 240. The septum 240 has a threaded mount aperture 242. An adapter plug 250 has a threaded mount portion 252 that fits into the mount aperture 242 formed in the septum 240 so as to connect the adapter plug 250 to the adapter body 232. Notably, in the illustrated embodiment, the adapter plug 250 is inserted into the adapter body 232 via the distal cavity 238 of the adapter body. The threaded connection between the plug mount portion 252 and the body mount aperture 242 enables the plug 252 to be positioned over a range of longitudinal positions relative to the adapter body 232.

The illustrated plug 250 has a distal cavity 254 defined at its distal base 256. When the plug 250 is installed on the atomizer body 232 as shown, a distal edge 258 of the plug 250 can engage the upper edge 76 of the bowl 70 so that the vaporization chamber 170 is defined by the bowl 70 and the distal cavity 254. In a manner similar as discussed above, the vapor V may flow from the vaporization chamber 170 through the slots 200 and into a lumen 110 defined between the plug 250 and an inner surface of the adapter body 232. In the illustrated embodiment, a plurality of first passages 260 are also formed through the plug 250, connecting the distal cavity 254 with the lumen 110. Thus, the vapor V can also flow from the vaporization chamber 170 through the first passages 260 and into the lumen 110.

The illustrated plug 250 also comprises a proximal cavity 262 that communicates with the adapter body proximal cavity 236. A plurality of second passages 264 formed in the plug 250 communicate the lumen 110 with the plug proximal cavity 262. Thus, vapor V within the lumen 12 can flow through the second passages 264 into the plug proximal cavity 262 and further to the module proximal cavity 236. In yet another embodiment, the bowl wall may not have slots, and thus vapor exits the vaporization chamber through the first passages only.

The embodiments discussed above have disclosed structures with substantial specificity. This has provided a good context for disclosing and discussing inventive subject matter. However, it is to be understood that other embodiments may employ different specific structural shapes and interactions. For example, the vaporizer embodiments discussed herein are generally cylindrical. It is to be understood that other embodiments may employ principles discussed herein in connection with vaporizers having different shapes and configurations. Also, the vaporizer embodiments discussed herein have employed electrically powered coils as elements for the atomizer module. It is to be understood, however, that other embodiments may employ other types of heating element structures, including electricity-based and/or gas-based heating element structures.

Although inventive subject matter has been disclosed in the context of certain preferred or illustrated embodiments and examples, it will be understood by those skilled in the art that the inventive subject matter extends beyond the specifically disclosed embodiments to other alternative embodiments and/or uses of the invention and obvious modifications and equivalents thereof. In addition, while a number of variations of the disclosed embodiments have been shown and described in detail, other modifications, which are within the scope of the inventive subject matter, will be readily apparent to those of skill in the art based upon this disclosure. It is also contemplated that various combinations or subcombinations of the specific features and aspects of the disclosed embodiments may be made and still fall within the scope of the inventive subject matter. Accordingly, it should be understood that various features and aspects of the disclosed embodiments can be combined with or substituted for one another in order to form varying modes of the disclosed inventive subject matter. Thus, it is intended that the scope of the inventive subject matter herein disclosed should not be limited by the particular disclosed embodiments described above, but should be determined only by a fair reading of the claims that follow.

What is claimed is:

1. A personal vaporizer, comprising:

an atomizer module comprising a bowl having a sidewall and a proximal edge, a heating element being arranged in or adjacent the bowl, the bowl being configured to accept a wax having an essential oil;

a battery assembly, the atomizer module connectable to the battery assembly so that actuation of the battery delivers electrical energy to the heating element, causing the heating element to heat and vaporize a wax that may be in the bowl;

a mouthpiece module defining a mouthpiece vapor passage in communication with a mouthpiece proximal outlet; and an adapter module interposed between the mouthpiece module and the atomizer module, and detachably connected to the atomizer module, the adapter module having an elongated hollow body and an adapter plug, the adapter plug supported by the elongated hollow body so as to move together therewith, and extending distally toward the heating element;

wherein the adapter plug has a distal end, the adapter plug arranged within the adapter module elongated hollow body so that the distal end is disposed adjacent the heating element so that a vaporizing chamber is defined between the heating element and the distal end of the adapter plug;

wherein the adapter plug distal end is configured so that vapor from the vaporizing chamber cannot pass therethrough; and wherein a vapor passage is defined between the adapter plug and the elongated hollow body.

2. A personal vaporizer as in claim 1, wherein a portion of the distal end of the adapter plug engages the proximal edge of the bowl.

3. A personal vaporizer as in claim 2, additionally comprising one or more slots formed through a side wall of the bowl.

4. A personal vaporizer as in claim 1, wherein the plug is selectively movable longitudinally relative to the elongated hollow body from a first longitudinal position at which the distal end is spaced a first distance from the heating element when the adapter module is connected to the atomizer module to a second longitudinal position at which the distal end is spaced a second distance from the heating element when the adapter module is connected to the atomizer module.

5. A personal vaporizer as in claim 1, wherein the vapor passage is defined by an outer surface of the adapter plug and an inner surface of the adapter module elongated hollow body.

6. A personal vaporizer as in claim 1, wherein a distal surface of the plug defines a distal cavity.

7. A personal vaporizer as in claim 1, wherein the distal end of the adapter plug is arranged distal of the proximal edge of the bowl and within the bowl.

8. A personal vaporizer as in claim 7, wherein a diameter of the distal end of the adapter plug is less than the diameter of the side wall of the bowl.

9. A personal vaporizer as in claim 3, wherein the one or more slots are formed at the proximal edge of the bowl so that each of the one or more slots cooperate with the distal end of the adapter plug to define a chamber outlet through which vapor may flow from the vaporizing chamber to the vapor passage.

10. A personal vaporizer as in claim 4, wherein the vaporizing chamber is larger when the adapter plug is in the first position than when the adapter plug is in the second position.

11. A personal vaporizer as in claim 4, wherein a proximal end of the adapter plug is attached to an attachment zone of the elongated hollow body, and the adapter plug extends distally from the attachment zone and is unattached to the elongated hollow body distal of the attachment zone, and wherein the attachment of the proximal end of the adapter plug to the attachment zone is configured so that so that the proximal end can selectively be moved proximally and distally in order to move the plug longitudinally relative to the adapter module.

12. A personal vaporizer as in claim 11, wherein the vapor passage is distal of the attachment zone.

13. A personal vaporizer as in claim 12, wherein a flow path extends radially outwardly from the vaporizing chamber around the distal end of the adapter plug into the vapor passage and proximally through the vapor passage.

14. A personal vaporizer as in claim 13, wherein a flow hole is defined through the elongated hollow body distal of the attachment zone, and the vapor passage communicates with the mouthpiece vapor passage through the flow hole.

15. A personal vaporizer as in claim 13, wherein a flow hole is defined through the adapter plug distal of the attachment zone, and the vapor passage communicates with the mouthpiece vapor passage through the flow hole.

16. A personal vaporizer as in claim 11, wherein a distal surface of the adapter plug has a first diameter, and an elongated body portion of the adapter plug proximal of the distal surface has a second diameter, and the first diameter is greater than the second diameter.

17. A personal vaporizer as in claim 1, wherein the distal end of the plug is configured to block vapor so that vapor within the vaporizing chamber is directed radially and into the vapor passage.

18. The personal vaporizer of claim 1, wherein the distal end of the adapter plug is distal of the mouthpiece module.

19. The personal vaporizer of claim 4, wherein a length of the personal vaporizer from a proximal end to a distal end of the personal vaporizer remains constant whether the adapter plug is in the first longitudinal position or the second longitudinal position.

20. The personal vaporizer of claim 1, wherein the adapter module is selectively removable from the mouthpiece module.

* * * * *